United States Patent [19]

Suchy

[11] Patent Number: 4,608,976

[45] Date of Patent: Sep. 2, 1986

[54] BREATHING PROTECTIVE APPARATUS WITH INHALATION AND EXHALATION REGULATOR

[75] Inventor: Les Suchy, North Vancouver, Canada

[73] Assignee: CanOcean Resources, Ltd., Canada

[21] Appl. No.: 649,158

[22] Filed: Sep. 10, 1984

Related U.S. Application Data

[63] Continuation of Ser. No. 348,871, Feb. 16, 1982, abandoned.

[51] Int. Cl.[4] ..... A62B 7/04

[52] U.S. Cl. ..... 128/204.26; 128/201.28; 128/205.24; 128/910; 137/116.3; 137/505.47; 137/527.4; 137/907

[58] Field of Search ..... 128/204.26, 201.27, 128/201.28, 910, 205.19, 205.24; 137/116.3, 505.47, 505.46, 533.17, 533.19, 527.4, DIG. 8; 251/298, 228

[56] References Cited

U.S. PATENT DOCUMENTS

| | | | |
|---|---|---|---|
| 2,085,249 | 6/1937 | Bullard | 128/205.12 |
| 2,310,902 | 2/1943 | Voelkel | 137/533.17 |
| 2,418,034 | 3/1947 | Kizaur | 128/204.26 |
| 3,028,859 | 4/1962 | Mitchell | 128/204.26 |
| 3,370,585 | 2/1968 | O'Neill | 128/204.28 |
| 3,468,307 | 9/1969 | Cummins | 128/204.26 |
| 3,481,333 | 12/1969 | Garrison | 128/201.28 |
| 3,595,226 | 1/1971 | Newcombe | 128/204.26 |
| 3,724,482 | 4/1973 | Ekstrom | 128/204.26 |
| 3,739,774 | 6/1973 | Gregory | 128/201.28 |
| 3,960,126 | 6/1976 | Shinoda | 137/505.47 |
| 3,965,892 | 6/1976 | Colston et al. | 128/201.27 |
| 3,973,588 | 8/1976 | Holst | 137/854 |
| 4,037,594 | 7/1977 | Riegel et al. | 128/201.27 |
| 4,137,912 | 2/1979 | O'Neill | 128/204.29 |
| 4,182,324 | 1/1980 | Hills | 128/201.27 |
| 4,211,220 | 7/1980 | O'Neill | 128/201.27 |
| 4,269,216 | 5/1981 | Sullivan et al. | 128/204.26 |

FOREIGN PATENT DOCUMENTS

| | | | |
|---|---|---|---|
| 640571 | 5/1962 | Canada . | |
| 648558 | 10/1962 | Canada . | |
| 807442 | 3/1969 | Canada . | |
| 833297 | 2/1970 | Canada . | |
| 1013230 | 7/1977 | Canada . | |
| 1022423 | 12/1977 | Canada . | |
| 1120279 | 12/1961 | Fed. Rep. of Germany . | |
| 2645675 | 4/1978 | Fed. Rep. of Germany | 128/204.26 |
| 942351 | 9/1948 | France | 128/204.26 |
| 1438515 | 7/1966 | France . | |

*Primary Examiner*—Henry J. Recla

*Attorney, Agent, or Firm*—Stevens, Davis, Miller & Mosher

[57] ABSTRACT

An improved breathing protective apparatus having an inhalation regulator and a primary source of breathing air supplied to the user through a pressure line, and an exhalation regulator with a return line connected to a vacuum source to remove exhaust gases from the work area is disclosed. The apparatus also has a positive pressure and free flowing regulator which provides an extra measure of safety in a toxic environment and provides low breathing resistance under high work load conditions. The arrangement is such that if the exhalation regulator is bypassed for exhaust without vacuum conditions, positive pressure and the free flowing regulator are automatically eliminated to save emergency air for escape of the user from a contaminated environment.

4 Claims, 6 Drawing Figures

BREATHING PROTECTIVE APPARATUS WITH INHALATION AND EXHALATION REGULATOR

This application is a continuation of application Ser. No. 348,871, filed Feb. 16, 1982 and now abandoned.

FIELD OF THE INVENTION

This invention relates to a breathing protective apparatus used for working in a contaminated or oxygen deficient environment, and in particular to breathing apparatus wherein breathable gas is supplied from a remote place, and exhaust gases are not discharged to the surrounding atmosphere.

BACKGROUND OF THE INVENTION

A conventional type of breathing protective apparatus is one wherein breathing gas, usually compressed air, is supplied through a hose to a demand valve connected with the mask of the user. During inhalation, the user receives the required amount of air and then exhaled gas is discharged to the surrounding atmosphere. The breathing mask may be maintained at slightly higher than ambient pressure, preventing inward leakage of toxic contaminants. However, in a confined environment where a high level of hydrocarbon gases or vapours are present, exhaled gas containing unused oxygen may create a potential explosion hazard.

Problems with the above described type of breathing apparatus are also evident if it must be used in an oxygen free inerted atmosphere, as discharge of oxygen into an inerted environment will require an additional costly inerting operation.

In order to increase efficiency in some closed-circuit under water breathing apparatus, the diver's exhaust gas is pumped back to a bell or submersible unit for $CO_2$ removal, reconstitution and recirculation. Due to the complexity of such a system, weight and high costs, that type of apparatus cannot be utilized as a breathing protective means for working in a contaminated atmosphere.

In more complex decompression chambers, a special oxygen breathing mask is employed to eliminate a need for a high ventilation rate for oxygen removal during oxygen breathing. This type of mask has a common demand valve controlling the oxygen flow during an inhalation, and an exhalation valve connected through a hose and dumping means with an outside decompression chamber. The small exhaust capacity of the exhalation valve when used with a vacuum source, and lack of positive pressure in the mask to prevent leaks of toxic contaminants, eliminates the possibility of using it for moderate work in atmospheres containing toxic gases or vapours.

The present invention overcomes the above mentioned problems by providing an improved breathing protective apparatus with an inhalation regulator and primary source of breathing air supplied to the user through a pressure line, and an exhalation regulator with a return line connected to a vacuum source to remove exhaust gases from the work area, the apparatus having a positive pressure and free flowing regulator to provide an extra measure of safety in a toxic environment and to provide low breathing resistance under high work load conditions.

Another feature of the invention is to provide a breathing apparatus of the type described, wherein a failure of the supply-return lines will allow a user to switch to an emergency air supply and bypass the exhaust regulator.

Yet another feature is to provide a breathing apparatus wherein bypassing the exhalation regulator for exhaust without vacuum conditions will automatically eliminate positive pressure and free flowing regulator to save emergency air for escape from a contaminated environment.

According to a broad aspect, the present invention relates to a breathing protective apparatus including a facemask having a regulator housing incorporating an inlet valve, an inhalation diaphragm controlling said inlet valve, an exhalation diaphragm and an outlet valve controlled thereby, a supply line connecting said inlet valve with a source of breathable air pumped under pressure to said valve; a return line connecting said outlet valve with a source of vacuum; said outlet valve and diaphragm therefor being so arranged that movement towards a closed position exerts a force on inlet valve lever means to create a positive pressure and small free flow in the facemask and regulator housing.

The invention is described with reference to the accompanying drawings, in which.

Figure 1:
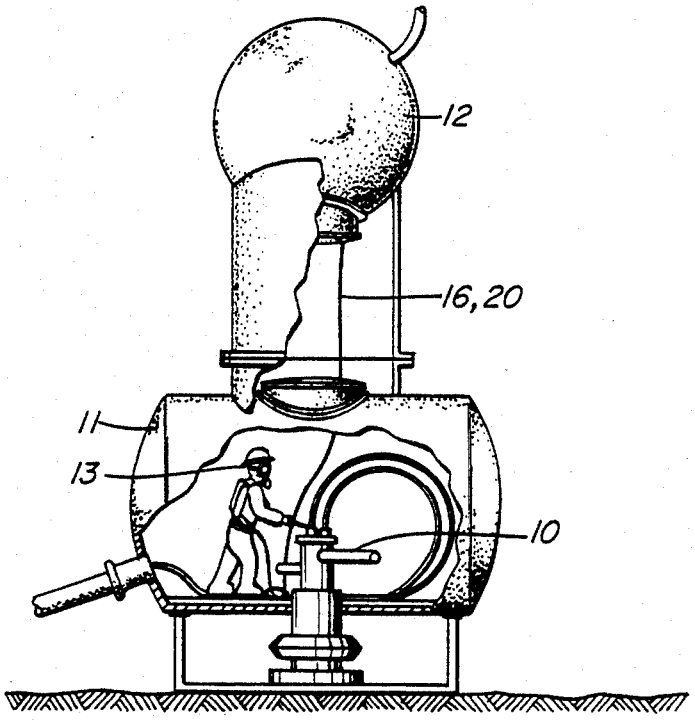
FIG. 1 illustrates the use of the present invention in an environment with a high level of hydrocarbon gases.

Referring to FIG. 1, there is shown a typical environment in which the present invention may be used.

Oil production equipment 10 which is encapsulated in a one-atmosphere pressure subsea chamber 11 and installed on the ocean floor may require an intervention for maintenance or troubleshooting. The access to the chamber 11 is possible through a one-atmosphere service capsule 12 supplied with compressible breathable air and vacuum from a surface support vessel, not shown. The atmosphere in the chamber 11 may be inerted to eliminate fire hazard due to a possibility of hydrocarbon gas leaks. The subsea operator 13 may enter and exit from the chamber through flexible hatches separating atmospheres in the chamber compartments.

Figure 2:
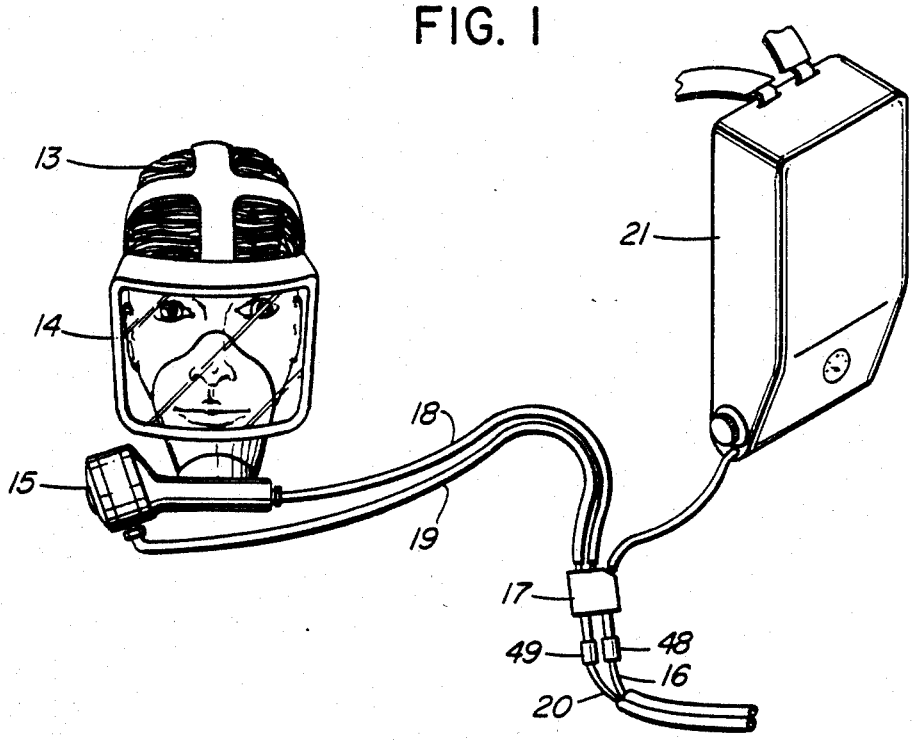
FIG. 2 shows a general arrangement of the present invention.

FIG. 2 shows the breathing apparatus of the present invention worn by an operator 13 and consisting of a face mask 14 with an integrated inhalation/exhalation regulator 15. Breathable air is fed under pressure through an umbilical supply line 16, manifold 17 equipped with a check valve and supply hose 18 into the regulator 15 and facemask 14. The exhaled gas travels back from the mask 14 and regulator 15, return hose 19 through the manifold 17, umbilical return line 20 and up to the topside vacuum source. Compressed air cylinders 21 with a pressure reducing means and suitable valves are provided for an emergency return to the service capsule 12 should a failure occur in the umbilical lines 16,20.

Figure 3:
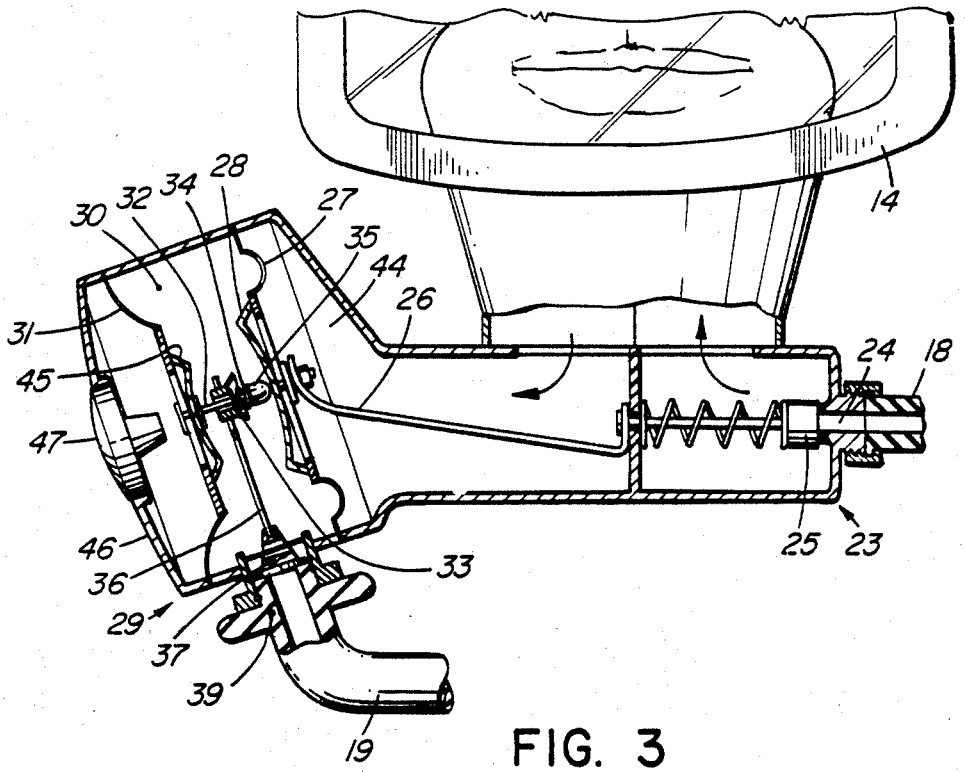
FIG. 3 is an elevation in cross-section of an embodiment of the present invention.

In FIG. 3 a typical inhalation regulator 23 is shown with the inlet port 24 closed by a spring loaded poppet valve 25, connected to lever 26 and controlled by an inhalation diaphragm 27 equipped with a check valve 28.

Figure 4:
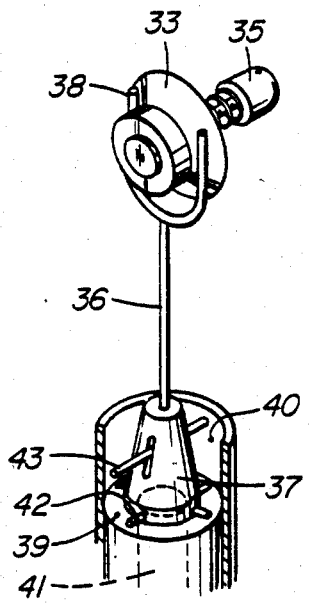
FIG. 4 is a detailed perspective view of the exhaust valve.

The exhalation regulator 29 has a cylindrical housing 30 with an exhalation diaphragm 31, actuator rod 32, disc 33, spring 34, and an adjustment nut 35 as illustrated in FIG. 4. A stem 36 of the exhaust tilt valve 37 is engaged with actuator rod 32 and disc 33 by means of a U-shaped fork 38.

Figure 6:
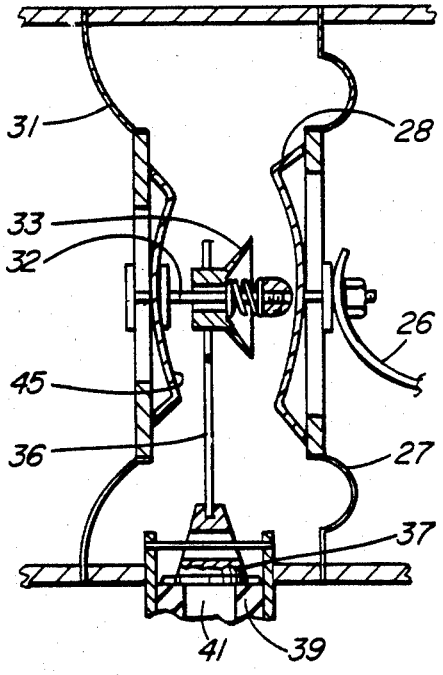
FIG. 6 is a sectional view illustrating the position of the exhaust regulator components when a vacuum is applied to the outlet.

The exhaust valve 37 is held in the closed position of FIGS. 3, 4 and 6 by a vacuum in the return hose 19 attached to the exhaust regulator 29 by a connector 39, FIG. 3.

The details of the exhaust valve 37 are shown in FIG. 4. A cylindrical cavity 40 holding the exhaust valve 37 is closed at its bottom by the return hose bayonet connector 39. By disconnecting the connector 39, an annular passage is formed between the walls of the cavity 40 and the valve body 37. Radial movements of the valve 37, ensuring overlapping of the conduit opening 41 in the connector 39, are restricted by pins 42 extending radially outwardly from the valve body 37 and the walls of the cavity 40.

Figure 5:
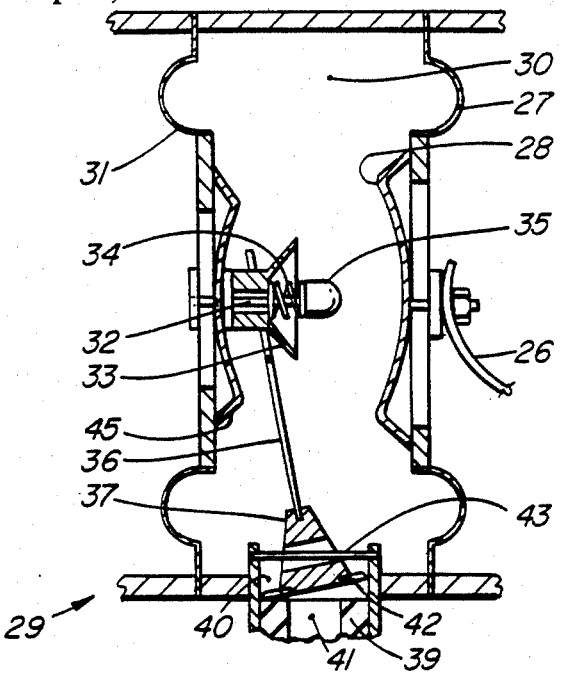
FIG. 5 is a sectional view showing the position of the exhaust regulator components without a vacuum.

Once the connector 39 is removed from the cavity 40, the axial movement of the valve 37 is restricted by a pin 43 attached to the walls of the cavity 40 and extending diametrically thereacross, passing through an elongated aperture in the valve body 37. Referring to FIG. 5 it will be seen that the inward and outward movement of the exhalation diaphragm 31 in housing 30 produces a tilting movement of the exhaust valve 37 in the cavity 40.

FIG. 5 further illustrates the position of the components of the exhalation regulator 29 when vacuum is not present in the conduit 41 of the return hose. The exhalation diaphragm 31 is positioned so that the exhaust valve 37 is held in a tilted open position.

In FIG. 6 the exhaust regulator 29 is shown with the vacuum applied to conduit 41. The suction developed between the valve body 37 and the opening of the conduit 41 overcomes stiffness of the diaphragm 31 and deflects it inwardly of the housing 30. The inward movement of the diaphragm 31 and the actuator 32 causes adjustment nut 35 to contact and move the inhalation diaphragm 27, thereby causing lever 26 to open the inlet port 24 of the inhalation regulator 23 by lifting valve 25 off its seat. With applied supply pressure and worn facemask 14 this in turn creates a flow of air and pressure build-up in the facemask 14 and regulator housing 44. The pressure differential opens a check valve 28 and pressure increases also in the exhaust housing 30, thereby moving the exhalation diaphragm 31 and the actuator rod 32 outward, terminating activation of the inhalation diaphragm 27 and related inflow. The outward movement of the actuator rod 32 compresses the spring 34 so that the movement does not affect the exhaust valve 37 still kept in the closed position.

Upon exhalation, exhaled gas flows from the facemask through the regulator housing 44, check valve 28, into the exhaust housing 30 applying exhaust pressure on the diaphragm 31.

The outward movement of the diaphragm 31 tilts open the exhaust valve 37 and the exhaled gas is carried away by the vacuum in the return hose 19. Once the exhaust flow and the corresponding exhaust pressure on the diaphragm 31 ceases, the suction closes valve 37 again causing the positive pressure build-up in the facemask 14.

The level of positive pressure eliminating the risk of contamination leak into the facemask could be set with the adjustment nut 35, FIG. 5, and position of the lever 26 in relation to the diaphragm 27.

The positive pressure inside housing 30 and the related force applied on the exhalation diaphragm 31, as well as the force from the elastic deflection of the diaphragm 31, helps to overcome the relatively high initial resistance to open exhaust valve 37. This arrangement of the regulator 29 permits effortless high volume exhalation. Furthermore, a small continuous flow of air through the facemask 14 and exhalation regulator 29 can be adjusted with nut 35 so that the visor of the mask is continuously flushed with fresh air, eliminating mask fogging during work and, even more important, the work of inhalation is greatly reduced.

To prevent a possible face squeeze, if exhaust valve 37 fails to close, a safety relief valve 45 is built into the exhaust diaphragm 31. A perforated cover 46 has an installed purge button 47, FIG. 3, allowing manual actuation of the regulator 15.

If the umbilical supply and return flow through the umbilical lines 16,20 are interrupted, the operator will open the emergency air supply 21 and disengage the return hose bayonet connector 39 from the exhaust regulator 29. Lack of actuation force from diaphragm 31 allows use of the emergency air supply on the normal demand mode. Exhaled gas passes through the check valve 28, annulus formed in cavity 40 and is discharged into the surrounding atmosphere.

If necessary, the operator can free himself from the umbilical lines by disconnecting the quick disconnects 48,49.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitation. There is no intention in the use of such terms and expressions to exclude any equivalents of the features shown and described or portions thereof, but it is recognized that various modifications are possible within the scope of the invention claimed.

I claim:

1. A breathing protective apparatus including a facemask with an inhalation/exhalation regulator comprising:

a body having an inlet port adapted to be connected to a source of compressed breathable gas, an exit port adapted to be connected to a source of negative pressure and a facemask port, said ports being in communication with each other and said facemask being connected to said facemask port;

said body enclosing an inhalation diaphragm and an exhalation diaphragm substantially parallel thereto to define an exhaust chamber therebetween, said diaphragms having a certain degree of resiliency, said exit port being located between said diaphragms in communication with said exhaust chamber;

an inlet valve mounted in said inlet port;

an exhaust valve means mounted in said exit port between the inhalation and exhalation diaphragms;

said inhalation diaphragm defining an inhalation chamber in free communication with the facemask;

said exhaust valve means including a valve head mounted for tilting movement between a position closing the exit port and tilted position opening the exit port, a stem extending from said valve head to a position between both diaphragms, an actuator rod mounted on and extending from the central portion of the exhalation diaphragm toward the central portion of the inhalation diaphragm and having lost motion connection to the exhaust valve stem so that movement of said exhalation diaphragm toward said inhalation diaphragm will not cause opening of the exhaust valve means, but movement of the exhalation diaphragm in the opposite direction will cause opening of the exhaust valve;

said exhaust valve being tiled to its open position soley by the movement of said exhaust diaphragm and moved to its closed position solely by the force of said negative pressure acting upon said valve head;

means connecting the inhalation diaphragm to said inlet valve for controlling the supply of gas to said facemask;

check valve means for one-way communication from said inhalation chamber to said exhaust chamber;

said diaphragms being mounted so they can be flexed and positioned with respect to each other such that flexing of said exhalation diaphragm toward said inhalation diaphragm causes movement of the exhaust valve means to its closed position simultaneously causes the distal end of the actuator rod to contact and to move the central portion of the inhalation diaphragm and to cause slight movement of said inhalation valve means which causes compressed gas to flow into said body and causes a slight increase in pressure therein which also pressurizes said exhaust chamber via said check valve means, said lost motion connection allowing said exhalation diaphragm to flex in said opposite direction a slight distance without opening said exhaust valve thereby allowing said inhalation diaphragm to move the same distance via said actuator rod to close said inhalation valve means;

whereby, as said body is under slight increased pressure, upon exhalation effort by a user, exhaled gas flows into the exhalation chamber and through the check valve means to the exhaust chamber to apply pressure on said exhalation diaphragm causing it to flex away from said inhalation diaphragm thus tilting and opening said exhaust valve means so that the exhaled gas is exhausted out the exit port and the negative pressure in said facemask port causes flexing of the inhalation diaphragm to open the inlet valve via the connecting means, thus admitting a fresh supply of breathable gas to the facemask.

2. The apparatus of claim 1 in which the exhaust valve means has a means restricting radial movement thereof and has a cross sectional area smaller than said exit port thereby permitting gas flow therebetween, said exhaust valve means having a valve seat removably mounted in said exit port and adopted for quick disconnection therefrom, whereby upon such disconnection said exhaust chamber is then open to ambient, said exhaust valve head equipped with a means restricting axial movement thereof upon said valve seat disconnection.

3. The apparatus of claim 1 in which said actuator rod has an adjustable means for altering length of the rod.

4. The apparatus of claim 1 in which said exhaust chamber has a safety relief valve for in-flow of ambient gas.

* * * * *